United States Patent [19]

Child

[11] Patent Number: 4,887,956

[45] Date of Patent: Dec. 19, 1989

[54] VARIABLE OUTPUT OIL PUMP

[75] Inventor: Robin E. Child, Leamington Spa, England

[73] Assignee: Concentric Pumps Limited, Great Britain

[21] Appl. No.: 168,961

[22] Filed: Mar. 16, 1988

[30] Foreign Application Priority Data

Mar. 20, 1987 [GB] United Kingdom ..... 8706630

[51] Int. Cl.[4] ..... F04C 2/10; F04C 15/04

[52] U.S. Cl. ..... 418/20; 417/218

[58] Field of Search ..... 417/213, 268, 220; 418/20, 24, 25, 26, 27

[56] References Cited

U.S. PATENT DOCUMENTS

| | | | |
|---|---|---|---|
| 3,957,396 | 5/1976 | Cooper | 417/218 |
| 4,259,039 | 3/1981 | Arnold | 418/26 X |
| 4,406,599 | 9/1983 | Stephan | 418/22 |
| 4,778,361 | 10/1988 | Child | 418/20 |

FOREIGN PATENT DOCUMENTS

| | | | |
|---|---|---|---|
| 76033 | 4/1983 | European Pat. Off. | 418/20 |
| 2513548 | 10/1976 | Fed. Rep. of Germany | 417/218 |
| 2120324 | 11/1983 | United Kingdom | 418/20 |

*Primary Examiner*—Michael Koczo

*Attorney, Agent, or Firm*—Learman & McCulloch

[57] ABSTRACT

The invention provides a variable output pump of the gerotor type in which one rotor meshes in two side by side annulii which can be aligned for maximum output and turned in opposite directions to be non-aligned for minimum output. The movement is effected by a gear train displaced by a rack which is hydraulically operated by pump pressure. Hence high pressure displaces the rack to result in lower output against lower pressure. A variation is described in which a control spool diverts fluid to either side of the piston according to need and this is displaced in one direction by the derived fluid pressure and in the other direction additionally by spring pressure transferred from the piston position by a lever system. This can give desired pump output/speed results at reduced power consumption.

2 Claims, 6 Drawing Sheets

VARIABLE OUTPUT OIL PUMP

This invention relates to variable output oil pumps of the kind described for example in EPA 0174734 in which a single male lobed rotor with n lobes extends through and is meshed with a pair of side-by-side female lobed annulii of n+x lobes (usually but not essentially x=1) and each annulus is journalled in a separate eccentric ring and has an external gear, each eccentric ring being journalled in the body of the pump. The two gears can be turned in opposite directions so that the eccentrics go from identical positions, when the annulii are aligned, to opposite generally mirror image non-aligned positions. This movement is relative to the fixed inlet and outlet ports of the pump and the effect is to go from maximum volume to minimum volume of the pumping chambers formed between the lobes: hence such movement changes the pump from maximum to minimum output or vice versa. But the actual output is also (at least approximately) proportional to the rotational speed.

The intent is to provide variable output between the extremes, necessary because the pumped fluid requirement, for example as i.c. engine lubricating oil, is not proportional to pump speed when the pump is driven, for example gear driven, from the engine.

The object of the invention is to provide an improved pump of the kind which is effectively self-adjusting in output. The power employed to drive the pump is to some extent proportional to output: hence the desire to avoid wastefully high output.

In accordance with the invention, a pump of the kind described is characterised by the provision of a hydraulic system using pressure derived, directly or indirectly to drive said gears in opposite directions.

The actual pump outlet pressure may be used, i.e. the outlet may be connected to a piston to drive said gears, or the oil pressure in a main lubricant gallery of the engine may be used, for example.

The invention is more particularly described with reference to the accompanying drawings in which.

Figure 3:
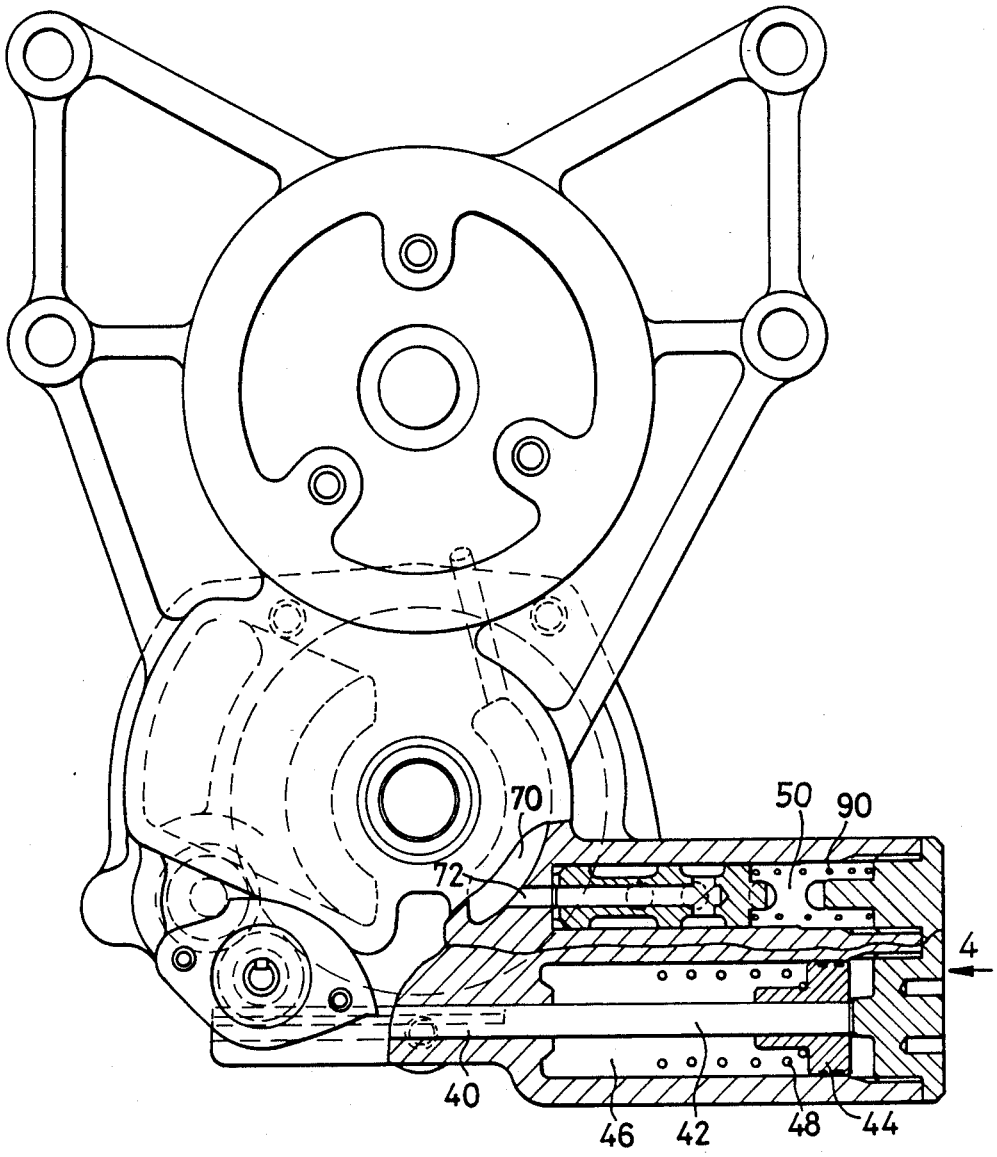
FIG. 3 is a view similar to FIG. 1 but with the different parts shown in section.
Figure 6:
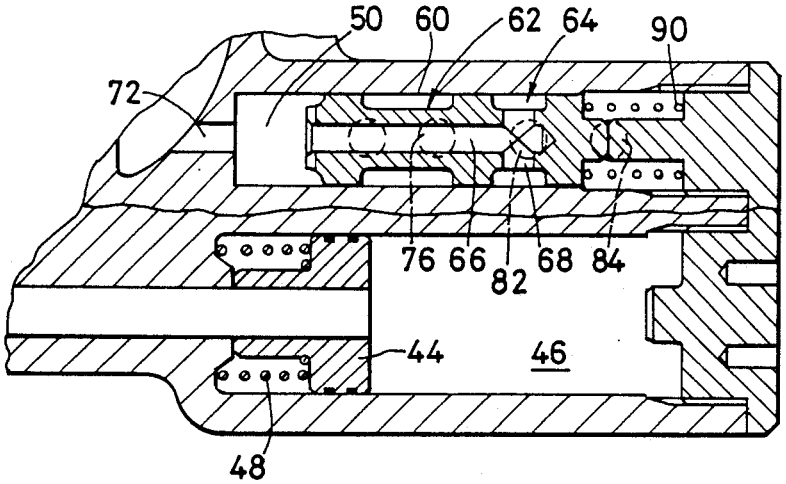
Figure 7:
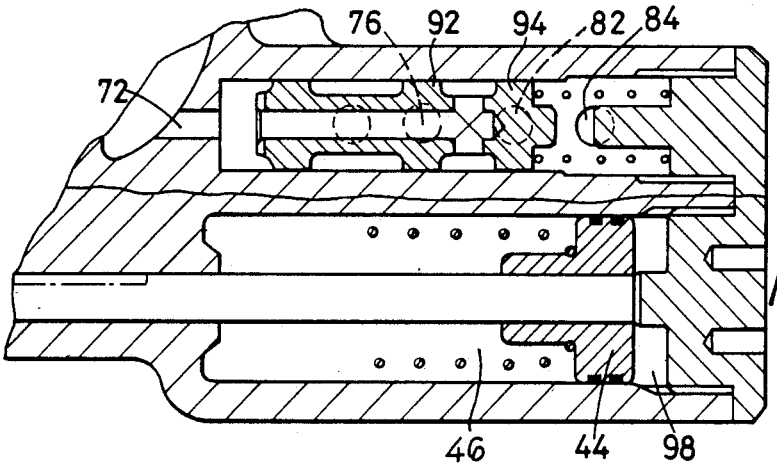
Figure 8:
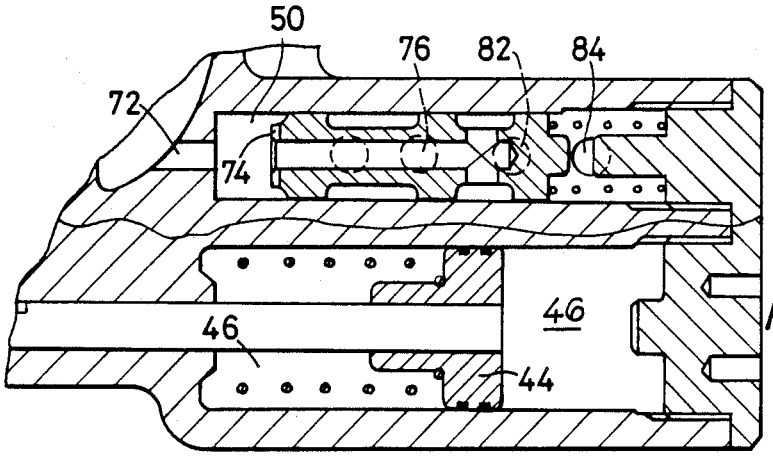
Figure 9:
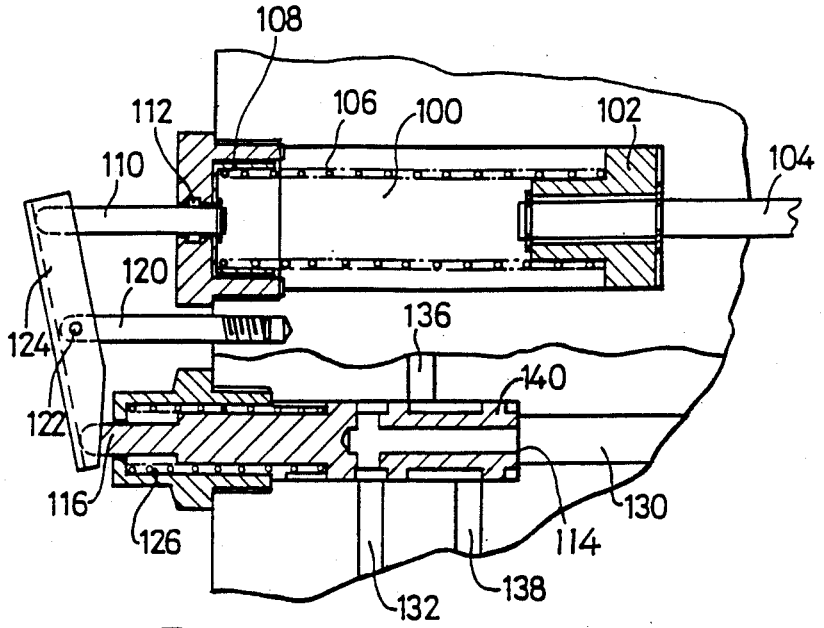

FIGS. 6, 7, and 8 are generally similar to a part of FIG. 3 but showing components in different positions at different points in a cycle;

FIG. 9 is similar to part of FIG. 3 but shows a different design; and

Figure 10:
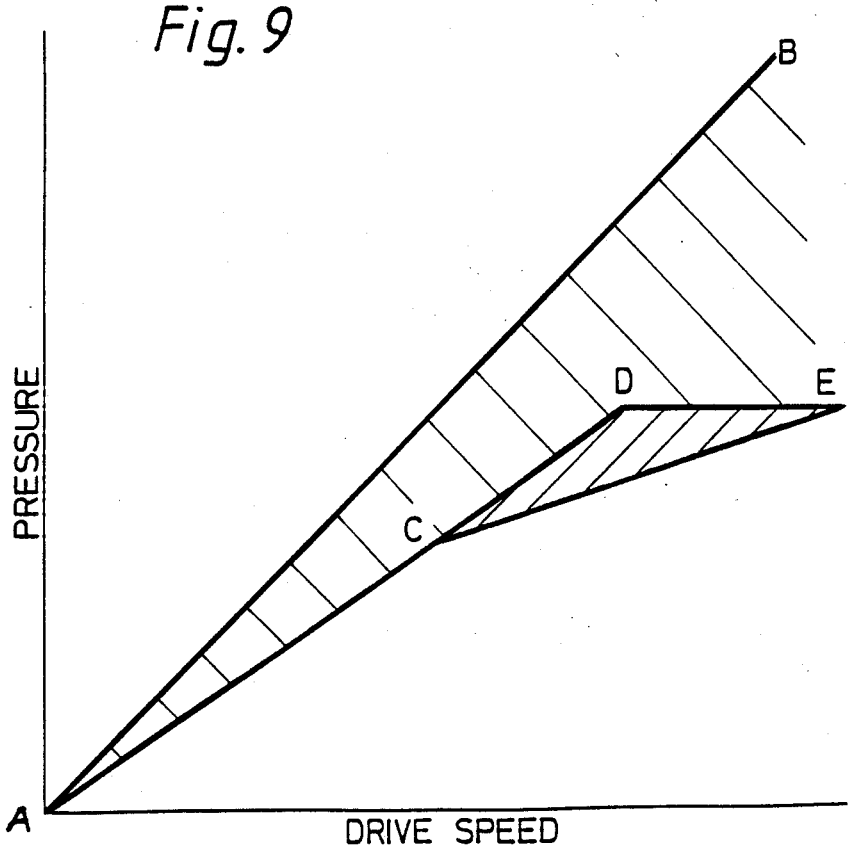

FIG. 10 is an illustrative performance graph.

Figure 1:
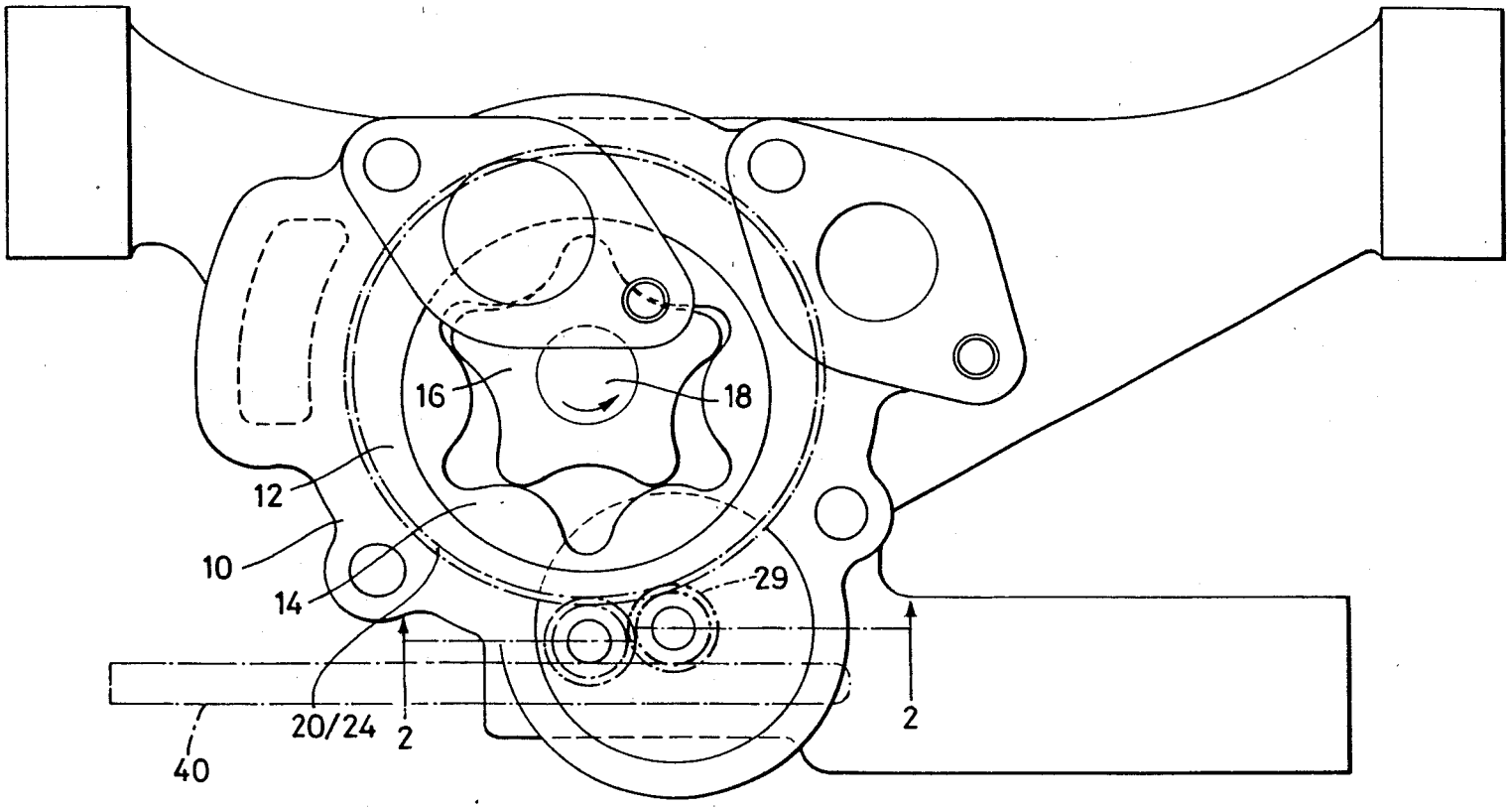
FIG. 1 is a diagrammatic elevation showing drive arrangements.
Figure 2:
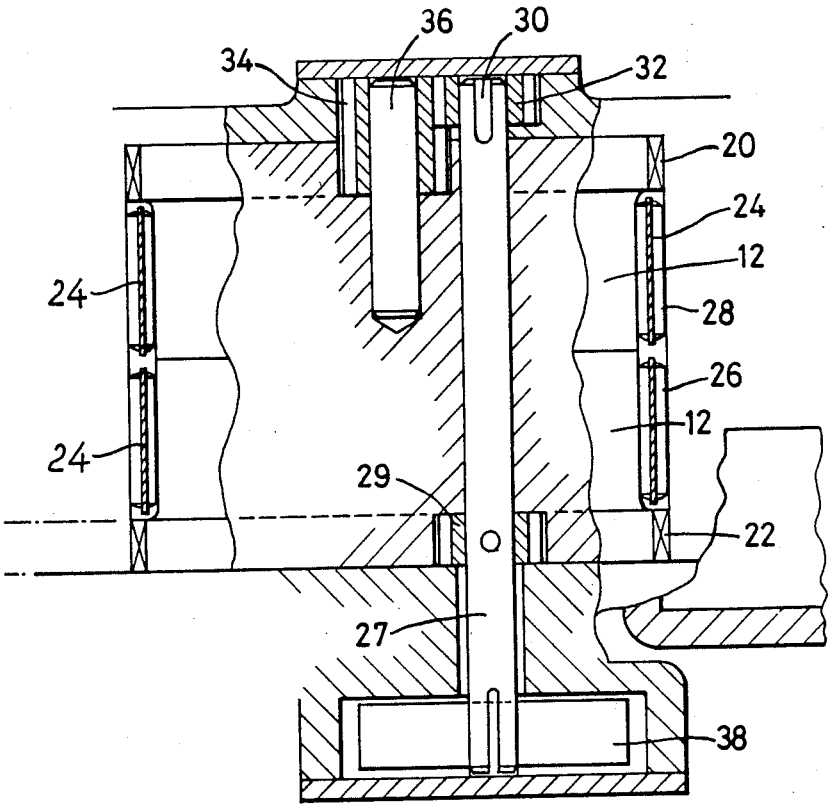
FIG. 2 is a sectional plan on line 2—2 of FIG. 1.

Turning now to the drawings and particularly FIGS. 1 and 2 thereof, the part 10 forms a casing for the pump to house the eccentrics 12 which in turn receive the internally toothed annuli 14 surrounding the rotor 16. The illustrated rotor 16 has five teeth and the annulus 14 has six teeth. However other formations are possible. The rotor is driven by shaft 18.

The rotor 16 is a single component but the annulus 14 is a pair of components located axially end-to-end, and each annulus is located in a corresponding eccentric.

As best seen in FIG. 2, the eccentrics are each provided with straight cut spur pinion teeth 20,22, and between the two sets of pinion teeth, two roller bearing cages 24 extend having two axially extending end-to-end sets of rollers 26,28 with individual cage sets to allow contra-rotation. The needle roller bearings are effective between the two eccentric components 12 and the casing 10.

The location of the needle rollers and the teeth is diagrammatically indicated in FIG. 1 by the reference 20/24.

The drive arrangements are best seen in FIG. 2. Drive shaft 27 is pinned to straight cut pinion 29 meshed with the gear ring 22. It is also keyed at 30 to a further such pinion 32 which is in turn meshed with pinion 34 journalled on shaft 36 and meshed with gear ring 20. It will be appreciated that when the shaft 27 turns, pinions 29 and 34 turn in opposite directions and likewise for the gear rings 20, 22 and hence the two eccentrics 12.

A clock spring 38 or another torsion spring is or may be provided and connected to the shaft 27 for example to return the same to a position in which the eccentricity is at a maximum.

In order to provide a drive for the shaft 27, pinion 29 is further meshed with rack 40. Said rack is fast with piston rod 42 (FIG. 3) which also carries piston 44 located in the main drive cylinder 46 with a helical compression spring 48 attached to the piston and effective to provide part of the return stroke of the piston under certain circumstances.

Parallel to the main cylinder 46 is a control bore 50 and the two are interconnected by a system of passageways as further described with reference to FIGS. 5 to 8.

Located in the control bore is spool 60 which has a pair of axially spaced waists 62,64, a through bore 66, and a transverse bore 68. The control bore is exposed to pump outlet pressure by means of the axially extending passage 72 communicating (in this instance) with the outlet port 70 FIG. 3.

As mentioned earlier, the control bore could be communicated into alternative pressure sources e.g. an engine gallery.

Figure 4:
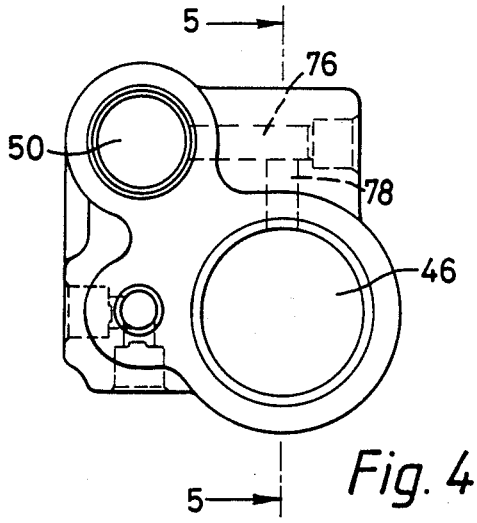
FIG. 4 is an end elevation in the direction of the arrow 4 on FIG. 3.
Figure 5:
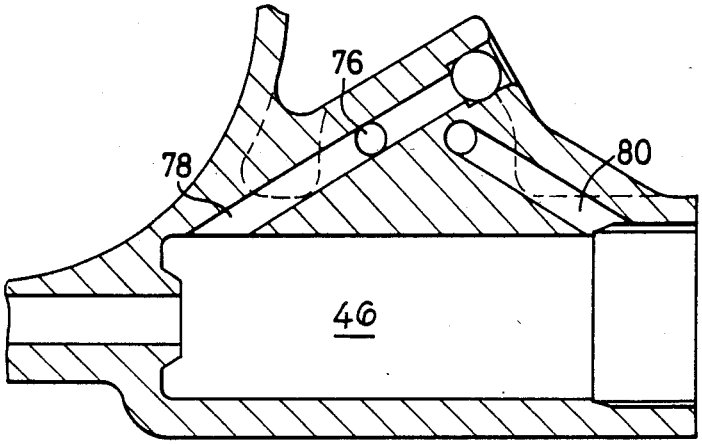
FIG. 5 is a section on the line 5—5 of FIG. 4.

When the parts are in the FIG. 3 position, the outlet pressure is communicated across the full cross sectional area of the spool 60 by means of radially extending channels 74 (FIG. 8) in the end face of the spool. In the FIG. 3 position the outlet pressure is communicated to the waist 64 via the axial passage 66 and through one of the ports 76 opening from the control bore which communicates by way of an intersecting passage 78 (FIGS. 4 and 5) to the front face of the main cylinder so as to act upon the main piston 44 and displace it to the right in the figures, thus displacing the rack in the same direction and applying drive to the eccentric rings for the purpose previously explained.

The movement of the piston to the right is possible as the fluid exits from the space behind the piston by way of a further angled passage 80 (FIG. 5) through passage 82 opening to the control bore and then via further passage 84 to exhaust for example to the engine sump. Passages 82 and 84 are at this time both exposed to the area behind the control spool, that is the spool at this time is in the same position as shown in FIG. 3. The main piston moves towards the full right position (FIG. 7) at this time, this corresponding to the full pump output mode.

As and when pump output pressure increases, so that the pressure acting upon the control spool to displace it to the right balances and exceeds the pressure provided by the control spring 90, the spool displaces until the full diameter portions of the spool 92,94 close the ports 76,82, as shown in FIG. 7. Further movement of the control spool to the right, towards the FIG. 8 position initially partly uncovers port 82 allowing flow from the outlet port to travel via passage 80 (FIG. 5) to the space 98 behind the main piston so as to reverse piston movement. During that reverse piston movement, the passages 78 and 76 allow for oil exhaust from the cylinder 46 in front of the piston. It will be appreciated that this reverse movement of the main piston reverses the eccentrics and reduces pump output, and the pressure drop may allow the control piston to return by spring 90, and so on.

The main spring 48 acting on the piston is shorter than the cylinder in which it is located, so that it is ineffective over part of the travel of the piston, but is effective when the piston is at extreme left position as shown in FIG. 6 and this ensures that when the pump is first installed or on startup, the whole arrangement will be in a position in which the oil pump is not at minimum output position, e.g. if the clockspring is not so effective or is not employed.

Turning now to FIG. 9, the arrangement is generally similar to FIGS. 1–8 and in particular FIG. 3 with a main cylinder 100 containing piston 102 attached to rack 104. FIG. 9 shows the rack in the extreme position in which the rotors are aligned for maximum volume output, e.g. as a startup. Spring 106 is a light compression spring extending between the piston and an end abutment 108 fixed to a drive pin 110 slidable in bush 112.

In the parallel control bore spool 114 is generally similar to the spool in the FIGS. 1 to 8 arrangement except for nose 116 which projects out of the pump body parallel to drive pin 110. A third parallel pin 120 provides a fulcrum at 112 for lever 124 which abuts both pins. A light spring 126 is provided to return the spool to the illustrated position when the pump is not running. The control spool is waisted and ported, and the control cylinder is ported and connected to the main cylinder in generally the same way and to the same effect as in FIGS. 1–8.

In operation, at startup the FIG. 9 arrangement is illustrated. The pump is at maximum volume setting. As the drive speed increases the volumetric output increases, and so does pressure in the system connecting via bore 130. The porting ensures that the communicated pressure holds the piston 102 in the rotor aligned full volume position.

When the pressure displaces the spool to the left the first result is to close the port 132 communicating fluid to the left hand end of the main cylinder. At the same time the nose 116 via lever 124 displaces end stop 108 so as to begin loading the spring 106.

Further small movement of the spool connects port 132 with the exhaust port 136 via the major waist of the spool whilst connecting the pressure source in 130 via port 138 to the right hand end of the main cylinder so that the piston 102 is displaced leftwards. At the same time the spool nose 116 further displaces the lever to displace the spring cap 108 to the right. From this point on the rack piston floats in position, being balanced by derived pressure acting on it and displacing it leftwards, but, via the spring 106 tending to displace the control spool rightwards, i.e. reduce or cut off the source of the derived pressure causing the movement. Also, the land 140 may be of the same width as the port 138 which means that small movements one way or the other connect port 138 alternately to exhaust or supply (136 or 140).

By these means it is now possible to stabilize pressure (and volumetric output) over a range of speeds. Moreover by suitable selection of parameters particularly for spring 106, it is possible to allow the rack to travel progressively as pressure rises before the floating and stabilized pressure regime becomes effective which can result in considerable power savings.

The power saving point is illustrated in FIG. 10. Turning now to FIG. 10, this is a generalised graph showing the pump output pressure/driven speed relationship for three different pumps. The line A-B is the possible straight line relationship for a constant output pump, for example the pump of the present invention if the rack were to be immobilised. The line A,C,D,E shows the results from the pump of FIGS. 1 to 8 where the part A,C,D results from the small progressive rack movement until the spring 48 becomes effective and the part D,E from the effect of the spring. The line A,C,E shows the effect of the FIG. 9 version with the portion C,E resulting from the floating or balance action of the rack piston. (It is assumed that point E is a desired pressure/speed relationship to be attained by the pump). Effectively the single hatched area is the saving in power achieved by the FIGS. 1 to 8 version and the cross-hatched area is the extra saving in power achieved by the FIG. 9 version, in both cases as compared to a fixed volume pump.

I claim:

1. In a pump of the kind having a body provided with an inlet port and an outlet port, a single male lobed rotor with n lobes which extends through and is meshed with a pair of side by side female lobed annuli of n=x lobes, each annulus being journalled in a separate eccentric ring having an external gear and being journalled in the body of the pump, and means for turning the gears in opposite directions so as to move the annuli between aligned identical positions for maximum pump output and non-aligned mirror image positions for minimum pump output, said movement being relative to the inlet and outlet ports of the pump, the improvement wherein the means for turning said gears comprises a hydraulic system having a piston in a cylinder, a control bore in communication with said cylinder via passageways, and a spool valve located in said control bore for directing pressure fluid to opposite sides of said piston, said spool valve being displaceable in one direction by pressure fluid from said outlet and in the opposite direction by pressure fluid displaced by movement of said piston.

2. A pump according to claim 1 including a lever system and a compression spring interposed between and abutting said lever system and said spool valve.

* * * * *